US012692044B2

(12) United States Patent
Arnell

(10) Patent No.: US 12,692,044 B2
(45) Date of Patent: Jul. 28, 2026

(54) DRINKING VESSELS

(71) Applicant: 752 LIFE LTD, Tunbridge Wells (GB)

(72) Inventor: Mark Arnell, Tunbridge Wells (GB)

(73) Assignee: 752 LIFE LTD, Truro (GB)

( * ) Notice: Subject to any disclaimer, the term of this patent is extended or adjusted under 35 U.S.C. 154(b) by 248 days.

(21) Appl. No.: 17/784,845

(22) PCT Filed: Dec. 14, 2020

(86) PCT No.: PCT/GB2020/053210

§ 371 (c)(1),
(2) Date: Jun. 13, 2022

(87) PCT Pub. No.: WO2021/116717

PCT Pub. Date: Jun. 17, 2021

(65) Prior Publication Data

US 2023/0009929 A1 Jan. 12, 2023

(30) Foreign Application Priority Data

Dec. 13, 2019 (GB) ..... 1918395

(51) Int. Cl.
*A45F 3/16* (2006.01)
*B65D 23/08* (2006.01)
*B65D 81/38* (2006.01)

(52) U.S. Cl.
CPC ..... *B65D 23/0885* (2013.01); *A45F 3/16* (2013.01); *B65D 81/3841* (2013.01)

(58) Field of Classification Search
CPC .... B65D 23/0885; B65D 81/3841; A45F 3/16
(Continued)

(56) References Cited

U.S. PATENT DOCUMENTS 2,754,866 A * 7/1956 Coltman, Jr. ..... B65D 47/0895 220/792
3,598,271 A * 8/1971 Holley ..... B65D 21/0219 215/393

(Continued)

FOREIGN PATENT DOCUMENTS

CN 2120097 U 10/1992
CN 108408235 A 8/2018

(Continued)

OTHER PUBLICATIONS

Invitation to Pay Additional Fees for International Patent Application No. PCT/GB2020/053210, mailed Apr. 20, 2021, 12 pages.

(Continued)

*Primary Examiner* — Don M Anderson
*Assistant Examiner* — Elizabeth J Volz
(74) *Attorney, Agent, or Firm* — Withrow + Terranova, PLLC; Vincent K. Gustafson

(57) ABSTRACT

A drinking vessel includes a bottle, a cup, and a cup lid. The bottle has a bottle base, a bottle mouth, and a bottle wall, the cup includes a cup base, a cup mouth, and a cup wall, a first face of the cup base and an inner face of the cup wall define a cup volume, a free edge of the cup wall defines the cup mouth. The cup lid is configured to close the cup mouth. The cup is configured so that the bottle base and at least a portion of bottle wall fit into the cup volume. The cup further includes a lid storage recess. The cup lid includes a cup wall engaging structure, and drinking aperture, and is configured to be reversibly retained in the lid storage recess.

20 Claims, 6 Drawing Sheets

(58) Field of Classification Search
USPC ..... 220/521, 916, 703, 737; 215/387, 6, 215/DIG. 7
See application file for complete search history.

(56) References Cited

U.S. PATENT DOCUMENTS

| | | | | | |
|---|---|---|---|---|---|
| 3,920,120 | A * | 11/1975 | Shveda | B65D 77/24 206/520 |
| 4,984,723 | A | 1/1991 | Hsu | |
| 5,398,843 | A * | 3/1995 | Warden | B65D 47/2018 220/254.1 |
| 6,152,318 | A | 11/2000 | Walker | |
| 11,858,688 | B2 * | 1/2024 | Hammond | A45F 3/16 |
| 2017/0190458 | A1 | 7/2017 | Tinsley | |

FOREIGN PATENT DOCUMENTS

| | | | |
|---|---|---|---|
| DE | 102010063295 | A1 | 6/2012 |
| KR | 20080033210 | A | 4/2008 |

OTHER PUBLICATIONS

International Search Report and Written Opinion for International Patent Application No. PCT/GB2020/053210, mailed Jun. 11, 2021, 15 pages.
First Office Action for Chinese Patent Application No. 202080096505.6 mailed Oct. 24, 2025, 17 pages.
Examination Report for Australian Patent Application No. 2020403641 mailed Oct. 22, 2025, 3 pages.

* cited by examiner

DRINKING VESSELS

This application is a 35 U.S.C. § 371 national phase filing of International Application No. PCT/GB2020/053210, filed on Dec. 14, 2020, and claims the benefit of United Kingdom Patent Application No. 1918395.3 filed on Dec. 13, 2019, wherein the entire contents of the foregoing applications are hereby incorporated by reference herein.

This invention relates to drinking vessels, and in particular to drinking vessels which combine a bottle for storage of a beverage and a cup suitable for use in drinking that beverage.

According to the present invention there is provided a drinking vessel comprising a bottle, a cup, and a cup lid, in which the bottle has a bottle base, a bottle mouth, and a bottle wall extending between the bottle base and the bottle mouth, the cup comprises a cup base, a cup mouth, and a cup wall, a first face of the cup base and an inner face of the cup wall define a cup volume, the cup volume is suitable for holding a potable beverage, and the inner face of the cup wall extends from the cup base to a free edge of the cup wall which defines the cup mouth, the cup lid is configured to reversibly engage with one or both of the free edge of the cup wall and the portion of the cup wall adjacent the free edge, and the cup lid is configured to close the cup mouth, characterised in that the cup base and cup wall are so configured that the bottle base and at least a portion of bottle wall fit into the cup volume with the inner face of the cup wall in close proximity to the portion of a bottle wall, the cup further comprises a lid storage recess in which the lid storage recess is defined by a second face of the cup base and an inner face of a recess wall, the second face of the cup base faces away from the cup volume, the inner face of the recess wall extends from the second face of the cup base away from the cup volume to a recess wall free edge, the recess wall free edge defines a recess mouth, the cup lid comprises a cup wall engaging means, and drinking aperture, the cup lid is at least partially elastically deformable, and insertion and removal of the cup lid into/out of the lid storage recess requires elastic deformation of the at least part of the cup lid.

The bottle wall and cup wall may be a single wall defining a bottle/cup of approximately circular cross-section (in a plane substantially perpendicular to a central axis of the bottle/cup, that central axis extending from the middle of the base of bottle/cup base to the middle of the bottle/cup mouth). Alternatively, the bottle wall and cup wall may comprise a number of flat or curved elements which, in combination, define the bottle/cup wall. The bottle/cup walls may be single skinned, or may be double skinned with a void between the skins. The void may be for insulation purposes and filled with a suitable insulator or a vacuum.

The drinking vessel of the present invention is advantageous because, as a whole it includes all the elements required for a user to store and drink a potable beverage, such as a hot or chilled drink. This includes a lid for the cup out of which the beverage is drunk. The lid helps prevent spillage and helps keep a hot or chilled drink hot or chilled respectively.

A further advantage of the drinking vessel of the present invention is that the lid for the cup is stored in the lid storage recess when not required. This helps avoid the loss of the lid.

The configuration of the lid and the lid storage recess is advantageous in that the elastic deformation of the lid required to place the lid in the recess at least partially reverses once the lid is in the recess and that reversal causes the lid to be retained in the recess. Once it is desired to take the lid out of the recess, a user deforms the lid, either by direct force or by pulling the lid causing the wall of the recess to deform the lid, which allows the lid to be removed from the recess. This is a simple mechanism which requires few parts and is unlikely to fail. This is particularly so if the lid is fully or partially formed from a suitable elastically deformable material such as a food grade silicone rubber.

In some embodiments, the cup lid is wholly elastically deformable. This has the advantage that there are no interfaces in the cup lid between elastically deformable parts and non-elastically deformable parts. Such interfaces may fail because of the difference in material properties either side of the interface.

In some embodiments the cup further comprises a base cap, in which the base cap is configured to reversibly close the mouth of the lid storage recess. In some embodiment, placing the lid into the lid storage recess comprises the steps of engaging the cup lid with one or more lid engagement means incorporated into or attached to the base cap, holding the base cap and inserting cup lid into the lid storage recess. In some embodiments the base cap may be engaged with the recess wall via an engagement means. In some examples, the engagement means can be a bayonet type engagement means. In other examples a screw thread.

In some embodiments, the recess wall comprises at least one retaining projection, in which each retaining projection extends from the free edge of the recess wall or from a portion of the inner face of the recess wall, and each retaining projection extends over the part of the recess mouth or into the lid storage recess. The lid can be elastically deformed to pass the or each retaining projection when placing the lid in or taking it out of the storage recess. When the lid is in the storage recess it will seek to resume its normal shape (the shape the lid has when not subject to deforming forces causing elastic deformation) and be lodged behind each retaining projection when viewed from outside the storage recess.

An example of a suitable retaining projection is a ridge, where the ridge extends in a longitudinal direction that is substantially to the free edge of the recess wall. In some embodiments the ridge extends the whole length or substantially the whole length of the free edge of the recess wall. In some other embodiments there is more than one ridge, those ridges being substantially parallel to the free edge of the recess wall, all of the ridges being on substantially the same plane, and being distributed along that free edge.

In some embodiments, at least one retaining projection is a retaining plate which extends between a portion of the free edge of the recess wall. In some embodiments the free edge of the recess wall defines a substantially circular recess mouth, and the retaining plate is substantially a circular segment.

In some embodiments there may be two or more retaining projections. Those retaining projection may be substantially of the same configuration as each other, or at least two retaining projections may be of different configurations, for example there may be two retaining projection, one a ridge as described above, and the other a retaining plate as described above.

In some embodiments, the cup wall engaging means of the cup lid is elastically deformable, and insertion and removal of the cup lid into/out of the lid storage recess requires the elastic deformation of the cup wall engaging means.

In some embodiments, the cup lid further comprises a deformation zone, the cup wall engaging means of the cup lid extends around the outside perimeter of the cup lid, the deformation zone is approximately parallel to the cup wall engaging means, and insertion and removal of the cup lid into/out of the lid storage recess requires the elastic deformation of the deformation zone. The deformation zone is a zone configured and adapted to be more elastically deformable than at least a portion of the rest of the lid.

In some embodiments of the present invention the cup lid further comprising a first lid element and a second lid element, the first lid element comprising the cup wall engaging means, the drinking aperture, and a rotating joint element, the second lid element comprising a drinking aperture closure element and a rotating joint element, the rotating joint elements of the first and second lid elements combine to form a rotating joint between the first and second lid elements, and rotation of the second lid element relative to the first lid element may move the second lid element between a closed position where the drinking aperture closure element may close the drinking aperture and an open position where the drinking aperture closure element may not close the drinking aperture.

The rotating joint may be of any known joint construction that allows the desired relative movement of the first and second lid elements. The relative movement may be such that the second element passes over the surface of the first element that is remote from the cup volume when the cup lid is attached to the cup wall free edge. In some embodiments, the rotating joint has the form of a 360° hinge with the rotating joint element of one of the first and second lid elements including a hinge pin and the other of the rotating joint elements having a recess for the hinge pin. In some embodiments, at least a portion of the second lid element is elastically deformable and deformation of the second lid element when it is in the closed position allows the drinking aperture closure element to close the drinking aperture. In some embodiments, the cup mouth is substantially planar, and the axis about which the second lid element rotates relative to the first lid element is within about 10 degrees of perpendicular to the plane of the cup mouth when the cup wall engaging means of the cup lid is engaged with the cup wall.

According to a second aspect of the present invention there is provided a drinking vessel comprising a cup and a cup lid, in which the cup comprises a cup base, a cup mouth, and a cup wall, a first face of the cup base and an inner face of the cup wall define a cup volume, the cup volume is suitable for holding a potable beverage, and the inner face of the cup wall extends from the cup base to a free edge of the cup wall which defines the cup mouth, the cup lid comprises a cup wall engaging means and a drinking aperture, the cup lid is at least partially elastically deformable, the cup lid is configured to reversibly engage with one or both of the free edge of the cup wall and the portion of the cup wall adjacent the free edge, and the cup lid is configured to close the cup mouth, characterised in that which the cup lid further comprises a first lid element and a second lid element, the first lid element comprises the cup wall engaging means, the drinking aperture, and a rotating joint element, the second lid element comprises a drinking aperture closure element and a rotating joint element, the rotating joint elements of the first and second lid elements combine to form a rotating joint between the first and second lid elements, and rotation of the second lid element relative to the first lid element may move the second lid element between a closed position where the drinking aperture closure element may close the drinking aperture and an open position where the drinking aperture closure element may not close the drinking aperture.

The advantages of the cup of the first aspect of the present invention are the same as the advantages of the cup of the second aspect of the present invention. The various embodiments of the cup lid described in connection with the first aspect of the present invention may apply to the cup of the second aspect of the present invention. In some embodiments, at least a portion of the second lid element is elastically deformable and deformation of the second lid element when it is in the closed position allows the drinking aperture closure element to close the drinking aperture. In some embodiments the cup mouth is substantially planar, and the axis about which the second lid element rotates relative to the first lid element is within about 10 degrees of perpendicular to the plane of the cup mouth when the cup wall engaging means of the cup lid is engaged with the cup wall.

In some embodiments, the cup further comprises a lid storage recess in which the lid storage recess is defined by a second face of the cup base and an inner face of a recess wall, the second face of the cup base faces away from the cup volume, the inner face of the recess wall extends from the second face of the cup base away from the cup volume to a recess wall free edge, the recess wall free edge defines a recess mouth, and insertion and removal of the cup lid into/out of the lid storage recess requires elastic deformation of the at least part of the cup lid.

In some embodiments, the cup wall engaging means of the cup lid is elastically deformable, and insertion and removal of the cup lid into/out of the lid storage recess requires the elastic deformation of the cup wall engaging means. In some embodiments, the cup lid further comprises a deformation zone, the cup wall engaging means of the cup lid extends around the outside perimeter of the cup lid, the deformation zone is approximately parallel to the cup wall engaging means, and insertion and removal of the cup lid into/out of the lid storage recess requires the elastic deformation of the deformation zone.

In some embodiments of this aspect of the present invention the cup further comprises a base cap as described in connection with the first aspect of the present invention.

According to a further aspect of the present invention there is provided a drinking vessel comprising a bottle, a bottle cap and a cup in which the bottle is comprised of a bottle base, a bottle mouth and one or more bottle walls, an edge of the or each bottle wall is joined to the bottle base, the or each bottle wall extends between the bottle base and the bottle mouth, the edge or edges of the or each bottle wall remote from the bottle base define the bottle mouth, and the or each bottle wall has an inner face, which defines the volume within the bottle in which a beverage may be stored, and an outer face, the bottle cap is configured to reversibly close the bottle mouth, the cup is comprised of a cup base, a cup mouth and one or more cup walls, the or each cup wall are joined to the cup base, the or each cup wall extend between the cup base and the cup mouth, an edge of the or each cup wall remote from the cup base defines or is adjacent to the cup mouth, and the or each cup wall has an inner face, which defines a volume within the cup, in which a beverage may be held, and an outer face, characterised in that the bottle comprises a lower portion and an upper portion in which the lower portion extends from the bottle base to a first intermediate position between the bottle base and the bottle mouth, the upper portion extends from a second intermediate position to a second position where the second intermediate position is between the first intermediate position and the second position, and the second position is between the second intermediate position and the bottle mouth, the cup is configured and dimensioned so that it can reversibly overlie the bottle base and at least a portion of the outer face of the lower portion of the bottle with the inner face of the or each cup wall in contact with or in close proximity to the outer face of the lower portion of the bottle, and the outer face of the or each cup wall adjacent to or at the cup mouth is of substantially the same dimensions as the dimensions of the outer face of the upper portion of the bottle at or adjacent to the second intermediate position.

In some embodiments the bottle base is circular or approximately circular and there is a single bottle wall which is extends from the bottle base to the bottle mouth.

In some embodiments the bottle base is non-circular, for example it may be a dodecagon and have twelve faces around the edge of the bottle base. In such embodiments there will be the same number of bottle side walls as faces on the edge of the bottle base The bottle wall is in some embodiments formed from a single component and may include curves, bends or folds to give the bottle a desired outer shape. In some other embodiments the bottle may be formed from two or more components suitably joined together. Those components may include curves, bends or folds to give the bottle a desired outer shape.

In some embodiments the cross section of the bottle in a plane perpendicular to the bottles actual axis is of substantially the same shape along the length of the central axis. The dimensions of the cross sections may be constant or vary along the length of the central axis.

In some embodiments the cross section of the bottle in a plane perpendicular to the central axis of the bottle is not of substantially the same shape along the length of the axis.

The bottle base may be formed as part of the same component as the or each bottle wall and as such be continuously joined to the or each bottle wall. In other embodiments the bottle base may be joined to the or each bottle wall by a suitable joining means, for example by an adhesive, by welding or a similar technique.

The material from which the bottle base and bottle walls are formed is, in some embodiments, a sheet metal. In some embodiments that sheet material is a metal that is not reactive with beverages because of inherent non-reactivity or because of a surface coating or treatment applied to the metal. An example of a suitable sheet material is food grade stainless steel.

The material from which the bottle base and bottle walls are formed is, in some other embodiments, a plastic material. Most preferably the plastic material is free from 5 bisphenol A (BPA).

The material of which the bottle is formed may be of medium or low thermal conductivity. The material of which the bottle is formed may be of a thermal conductivity less than 60 W/mK, or less than 46 W/mK.

In some embodiments the cup base is of substantially the same shape as the bottle base.

In some embodiments the cup base is formed as part of the same component as the or each cup wall and as such is continuously joined to the or each cup wall. In other embodiments the cup base may be joined to the or each cup wall by a suitable joining method for example by use of an adhesive, by welding or a similar technique.

The material from which the cup base and cup walls are formed is, in some embodiments, a sheet metal. In some embodiments that sheet material is a metal that is not reactive with beverages because of inherent non-reactivity of the metal or because of a surface coating or treatment applied to the metal. An example of a suitable metal is food grade stainless steel.

The material from which the cup base and bottle cup are formed is, in some other embodiments, a plastic material. The plastic material may be free from bisphenol A (BPA).

The material of which the cup is formed may be of medium or low thermal conductivity. Preferably the material of which the cup is formed is of a thermal conductivity less than 60 W/mK, or less than 46 W/mK. 4

In some embodiments the material of which the cup is formed is the same material as that from which the bottle is formed.

The cup is configured and dimensioned so that it may overlie at least a portion of the lower portion of the bottle. The cup may overlie at least a substantial portion of the lower portion of the bottle. The contours and dimensions of the inner face of the or each cup wall and the cup base may be such that they substantially match the contours of the outer face of the lower portion of the bottle and the bottle base. This has the result that at least a portion of or at least a substantial portion of the lower portion of the bottle are closely overlaid by the cup.

In some embodiments, when the cup overlies the lower portion of the bottle to its maximum extent at least a portion of the outside face of the bottle base abuts the inner face of the cup base. In this context, the outside face of the bottle base is to be understood to include any rim around the edge of the bottle base or other projections from the outside face of the bottle base.

In some embodiments the outer face of the bottle base may be so configured that there is a void between at least a portion of the outer face of the bottle base and the inner face of the cup base when the cup overlies the lower portion of the bottle to its maximum extent. This void will accommodate any residue of beverage in the cup when the cup is put onto the bottle. This configuration will stop the residue being displaced and flowing out of the cup when the cup is put onto the bottle.

In some embodiments the cup may slidingly be placed over the lower portion of the bottle. In some embodiments the dimensioning of the lower portion of the bottle and the cup are such that the cup is retained on the lower portion of a bottle by a friction grip.

The cup may be so configured that the outer face of the cup at or adjacent to the cup mouth is of substantially the same dimensions as the outer face of the upper portion of the bottle at or adjacent to the second intermediate position. This has the effect that the outer face of the combined bottle and cup have, overall, a relatively smooth outer surface profile.

In some embodiments the cup overlies sufficient of the lower portion of the bottle that there is less than 5 mm, 4 mm, 3 mm, or 2 mm gap between the edge of the or each cup wall adjacent the cup mouth and the edge of the upper portion of the bottle where it is adjacent the lower portion.

In some embodiments there is be a gap between the edge of the or each cup wall adjacent the cup mouth and the edge of the upper portion of the bottle. In some embodiments this gap is at least partially filled with the whole or a part of a seal ring (which is discussed further below), or a sleeve. The seal ring or sleeve may be so dimensioned that the surface profile of the outside face of the upper portion of the bottle, the seal ring or sleeve, and outside face of the cup form a substantially smooth surface.

The sleeve may be formed from an elastomeric material, it may be a thermally insulating elastomeric material. Suitable materials for the sleeve are, for example, a silicone, a plant originating rubber, for example guayule rubber, a softish BPA-free plastic (for example LDPE), or a carbon-based polymer. The sleeve may be formed in a contrasting colour to that of the bottle and or cup for ascetic purposes. The sleeve may carry images or text. Other possible materials for the sleeve are plant originating rubber such as guayule rubber, In some embodiments at least a substantial portion of the lower portion of the bottle side wall or walls has a wall thickness of up to a first wall thickness, at least a substantial portion of the upper portion of the bottle side wall or walls has a wall thickness of at least a second wall thickness, and the second wall thickness is greater than or equal to the first wall thickness.

Such a structure is advantages because it allows the outer face of the bottle to be configured as described above whilst the inner face of the bottle is smooth between the bottle base and bottle mouth. Such a smooth inner face of the bottle is particularly important to allow complete cleaning of the inner face of the bottle.

In some embodiments the bottle is formed from walls which comprise an inner skin and an outer skin. In some embodiments the inner skin and outer skin of the upper portion of the bottle are spaced from each other. The space between the inner and outer skins may be occupied by a gas or a mixture of gasses. The gas may be an inert gas such as such as argon, xenon or krypton. Alternatively, the gas may be some other gas or mixture of gases, for example, air. In use, that gas acts as an insulator located between the inner and outer skins of the bottle. The use of the air between the inner and outer skins has the advantage that it is the least ecologically damaging or costly filling for the space between the inner and outer skins. In other embodiments a gas or mixture of gases at sub-atmospheric pressure may be used to occupy the space between the inner and outer walls. The sub-atmospheric pressure may be between a vacuum and about one atmosphere (about 101.3 kPa). Again, such a filling for the space between the inner and outer skins will help thermally insulate the content of the bottle from the outside. In other embodiments, the space between the inner and outer skins may be at least partially occupied by a foam or fibrous material which can, again, act as a thermal insulator.

For the lower portion of the bottle wall, the same considerations and possible constructions apply as for the upper portion. In some embodiments, the space between the inner and outer skins of the lower portion of the bottle is in communication with the space between the inner and outer skins of the upper portion of the bottle. It will be understood that the insulating properties of the lower portion of the bottle are to be expected to be lower than the upper portion because the lower portion of the bottle wall is thinner than the upper portion of the bottle wall.

The lower thermal insulating properties of the lower portion of the bottle are, in use, supplemented by the cup when the cup overlies the lower portion of the bottle. This is because the cup of the drinking vessel will, when overlying the lower portion of the bottle, surround the lower portion of the bottle and thermally insulate the lower portion of the bottle. The thermal insulation of the cup is, in some embodiments, achieved as a result of the cup side walls having an inner cup skin and an outer cup skin which are spaced from each other. The space between the inner and outer cup skins may, as with the bottle walls, be occupied by a gas or a mixture of gasses. The gas may be an inert gas such as such as argon, xenon or krypton. Alternatively, the gas may be another gas or a mixture of gases, for example air. In use, the gas acts as an insulator located between the inner and outer skins of the cup. The use of air is advantageous because it is the least ecologically damaging or costly filling for the space between the inner and outer skins. In other embodiments a gas at sub-atmospheric pressure may occupy the space between the inner and outer skins of the cup. The sub-atmospheric pressure may be between a vacuum and about an atmosphere (about 101.3 kPa). Again, such a filling for the space between the inner and outer skins will help thermally insulate the content of the bottle from the outside. In other embodiments, the space between the inner and outer skins may be at least partially occupied by a foam or fibrous material which can, again, act as a thermal insulator.

The combination of the thermal insulation provided by the lower portion of the bottle and the cup when the cup overlies that lower portion may be equal to or greater than the thermal insulation properties of the upper portion of the bottle. This has the advantage that when the bottle is only partially full, and hence the content of the bottle more susceptible to temperature change than when the bottle is full, the partial contents when the drinking vessel is orientated so that the cup base is lowermost, will, be subject to a greater amount of thermal insulation from the combined bottle and cup than the contents of the upper portion of the bottle when the bottle is full.

In some embodiments the location of the first intermediate position on the bottle to which the lower portion of the bottle extends may be influenced by the desired volume or capacity of the cup. That volume is defined by the inner face of the cup base and the or each cup wall. The larger the desired volume of the cup the further the first intermediate position is from the bottle base.

In some alternative embodiments the location of the first intermediate position is pre-determined and the dimensions of the cup calculated to match the location of the first intermediate position.

In some embodiments, the location of the second intermediate position on the bottle may be substantially coincident with the first intermediate positon. In such embodiments the thickness of the wall may change between the lower portion and the upper portion in a stepwise fashion. That step is on the outer face of the bottle wall or walls. In some other embodiments there may be a taper between the outer face of the portion of the bottle wall that comprises the lower portion and the outer face of the portion of the bottle wall that comprises the upper portion of the bottle.

In some embodiments there is provided a seal ring which extends around the outside face of the bottle and overlies a portion of the lower portion of the bottle. The seal ring may be held in position by one or both of a suitable adhesive, or the seal ring is elastically stretched when it is placed in a position to extend around the bottle and then allowed to relax so that the forces seeking to contract the seal ring back to its original dimensions (which are smaller than the portion of the lower portion of the bottle over which the seal ring is to lie) hold the seal ring in position.

The seal ring and the inner face of the cup are, in the aforementioned embodiment, configured so that the inner face of the cup side wall at least partially overlies the seal ring when the cup overlies the lower portion of the bottle to the maximum extent. In such a position, the inner face of the cup may at least partially compress the seal ring. This has the result that the seal ring in seeking to decompress grips the inner face of the cup and holds the cup in position until such time as the cup is pulled off the seal ring. The seal ring may be a silicone rubber material because of its resistance to heat and its acceptability for use in the construction of drinking vessels. Other possible materials are, a plant originating rubber, for example guayule rubber, a softish BPA-free plastic such as, for example LDPE, or a carbon-based polymer.

In some embodiments the first intermediate position and second intermediate position are spaced from each other. In such embodiments the outer face of the bottle is preferably so contoured that there is a waist or narrowing created between the first and second intermediate positions. That waist or narrowing has a cross section smaller than the cross section of the lower or upper portion of the bottle adjacent the waist or narrowing. In such embodiments there is provided a seal ring which is so dimensioned and configured that at least a portion of the seal ring will occupy the waist or narrowing.

The seal ring may be elastically stretched when it is placed in a position to extend around the bottle and overlie the waist or narrowing and allowed to relax so that the forces seeking to contract the seal ring back to its original dimensions (which are smaller than the waist or narrowing) hold the seal ring in position. Such a construction avoids the need for an adhesive to retain the seal ring in position. It is beneficial to not have to use adhesives because adhesives are generally solvent based and it is environmentally detrimental to release those solvents when such adhesives are cured.

The seal ring may be configured so that the cup can be reversibly pushed in to a position which at least a portion of the seal ring is overlaid by the inner face of the cup wall and compressed by the cup wall. As a result, the cup is retained in position by the seal ring.

In some embodiments the cup further comprises a storage recess and a cup lid, in which the cup lid is configured to be able to reversibly engage with the cup mouth and or the or each cup wall so as to reversibly close the cup mouth. The storage recess is configured to reversibly retain the cup lid within the storage recess.

Such a configuration allows a user to place the cup lid within the storage recess when the cup is to overlie the lower portion of the bottle. When the cup is to be used, the cup is taken off the lower portion of the bottle, and the cup lid removed from the storage recess. A beverage may be then poured from the bottle into the cup, and the cup mouth closed using the cup lid. It is preferred that the cup lid comprises one or more apertures through which the beverage may be drunk. The cup lid may further comprise a closure means to reversibly close the or each aperture. Such closure means may, in some embodiments, form a liquid tight closure.

The cup lid of some embodiments of may cause the cup of the drinking vessel to have the configuration of a "travel cup" which both allows a user to drink from the cup and seeks to minimise any spillage from the cup when the cup is jogged or knocked. The cup lid has the further benefit of helping prevent any beverage in the cup either cooling down or warming up dependent on the initial temperature of the beverage relative to the ambient temperature.

In some embodiments, the cup lid is so constructed that the portion of the cup lid that engages with the cup mouth or the or each cup wall adjacent to the cup mouth, and or the storage recess is elastically deformable. In such embodiments the cup lid is retained in position in the storage recess or in closing the cup mouth by elastic deformation of the deformable portion of the cup lid.

The storage recess in the cup is may be defined by the cup base and one or more storage recess walls. The storage recess walls may extend in a direction away from the cup mouth and the cup base. The storage recess walls thus form a recess which, when the cup is placed upon a surface with the cup mouth uppermost, faces towards that surface. In some embodiments, the storage recess is sufficiently deep that the cup lid can be fully housed within the recess. In some embodiments, when the cup lid is fully within the storage recess, the cup lid does not contact a flat surface on which the cup is placed when the cup mouth is furthest from the surface.

In some embodiments the cup lid and the cup mouth or the or each cup wall adjacent to the cup mouth are provided with mechanical means by which to engage with each other, for example screw threads. In such embodiments similar mechanical means are also provided on an inside face of the storage recess so that the cup lid can be mechanically engaged within the storage recess to retain the cup lid in that position.

In some embodiments the bottle cap is comprised of an outer cap skin and an inner cap element, the outer cap skin is configured and dimensioned to reversibly engage with the bottle mouth or the or each bottle wall adjacent to the bottle mouth, and the inner cap element is configured to reversibly engage with the outer cap skin. In such embodiments the outer cap skin is preferably of an inert material such as a metal or plastics and reversibly seals the mouth of the bottle so that liquid cannot escape the bottle when it is sealed.

In some embodiments the inner cap element is removable from the outer cap skin and, as such, in a cap element of different configurations may be interchanged with each other. For example, a first inner cap element may comprise a raised bar extending across the face of the inner cap element that is remote from the outer cap skin. That bar may be used as a handle for moving the bottle cap. It may, in some embodiments, comprise an aperture through the bar so as to allow the attachment of a handle or other attachment. A second inner cap element may be configured with a different configuration or perhaps a different colour allowing a user of the bottle to personalise their bottle. The inner cap element preferably also acts as a thermal insulator.

In some embodiments the means for engagement between the outer cap skin and the inner cap element is a screw thread. In some embodiments thee screw thread is a left hand screw thread.

In some embodiments the means for engagement between the outer cup skin and the inner cap element is an adhesive, or welding.

Within the scope of this application it is expressly intended that the various aspects, embodiments, examples and alternatives set out in the preceding paragraphs, in the statement of invention, the claims and/or in the following description and drawings, and in particular the individual features thereof, may be taken independently or in any combination. That is, all aspects/embodiments and/or features of any embodiment can be combined in any way and/or combination, unless such features are incompatible. The applicant reserves the right to change any originally filed claim or file any new claim accordingly, including the right to amend any originally filed claim to depend from and/or incorporate any feature of any other claim although not originally claimed in that manner.

The present invention will be further described and explained by way of example and with reference to the accompanying drawings in which FIG. 1 shows a side view of a drinking vessel according to an embodiment of the present invention;

Figure 1:
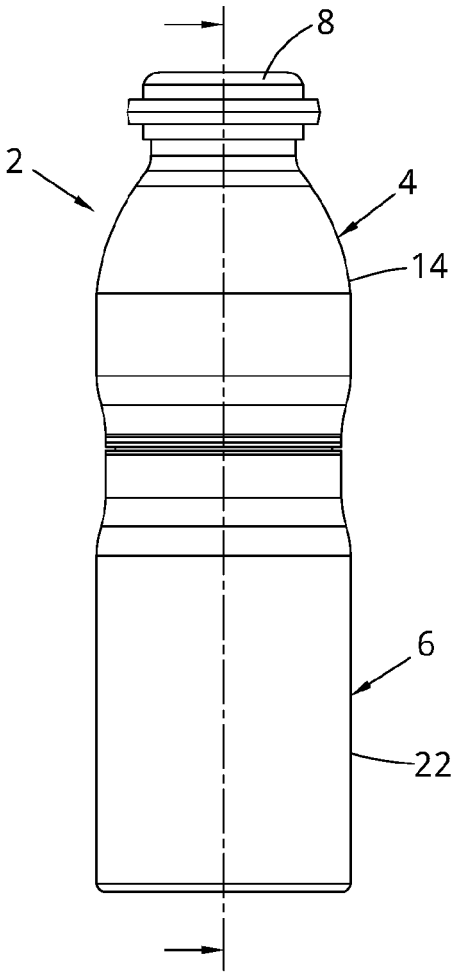
Figure 2:
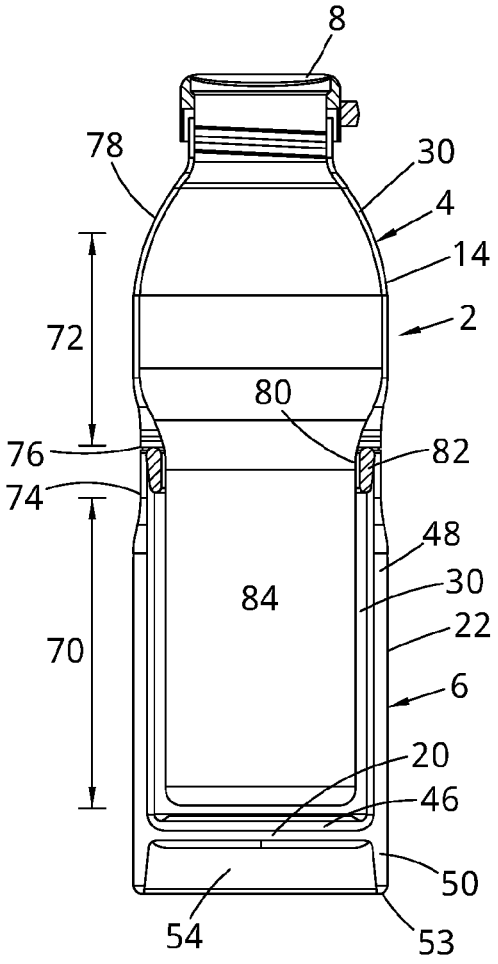
FIG. 2 shows a cross section of the drinking vessel of FIG. 1 along the section AA.

With reference to FIGS. 1 and 2, a drinking vessel 2 is comprised of a bottle 4, a cup 6, and a bottle cap 8.

Figure 3:
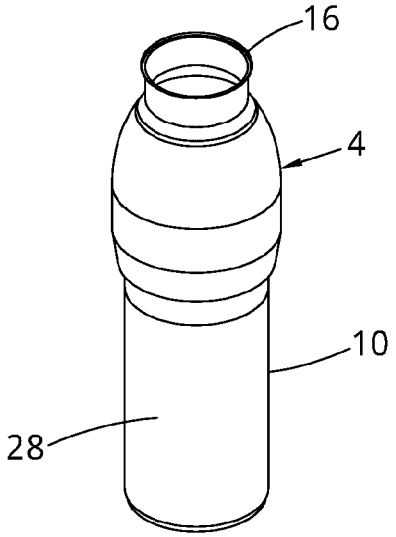
FIG. 3 shows the inner skin of the bottle wall of the drinking vessel of FIG. 1.
Figure 4:
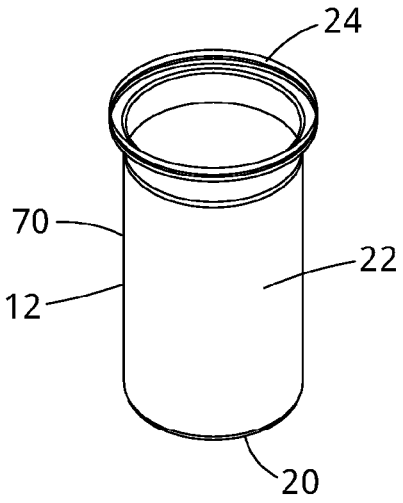
FIG. 4 shows the lower portion of the outer skin of the bottle wall of the drinking vessel of FIG. 1.
Figure 5:
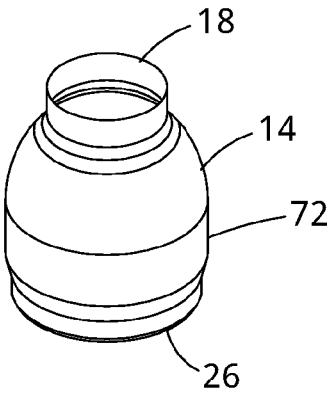
FIG. 5 shows the upper portion of the outer skin of the bottle wall of the drinking vessel of FIG. 1; 25

With reference to FIGS. 3, 4 and 5, the bottle 4 is comprised of an inner skin element 10, a first outer skin element 12, and a second outer skin element 14. The inner skin element 10 is configured so as to fit within and be spaced from the outer skin 10 elements 12 and 14 other than at the mouth rim 16 of the inner skin 10. Mouth rim 16 is adapted to engage with the mouth rim portion 18 of the second outer skin element 14. The mouth rim 16 is adapted to engage with the mouth element 18 by folding, crimping, welding, gluing, or other appropriate joining means.

The first outer skin element 12 includes a base 20, a side wall portion 22, and an upper rim 24. The upper rim 24 is adapted to engage with a lower rim 26 of the second outer skin element 14. The engagement between the upper rim 24 and the lower rim 26 is again made by folding, crimping, welding, gluing, or other appropriate joining means.

To construct the bottle, the portion 28 of the inner skin 10 is located within the volume defined by the outer skin 12, the second element 14 of the outer skin is placed over the top of the inner skin 10 and the rims 16 and 18 are joined as are the rims 24 and 26. This creates a void 30 between the inner skin 10 and the now 25 complete outer skin 12/14.

Figure 6:
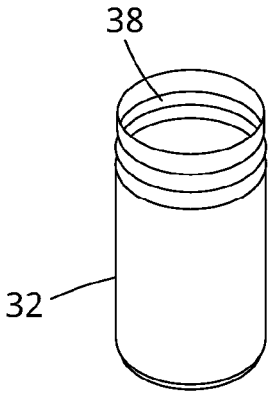
FIG. 6 shows the outer skin of the cup wall of the drinking vessel of FIG. 1.
Figure 7:
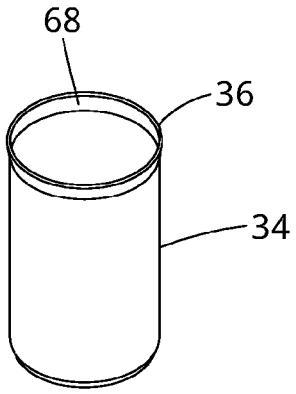
FIG. 7 shows the inner skin of the cup wall of the drinking vessel of FIG. 1.

With reference to FIGS. 6 and 7, the cup 6 is comprised of an outer skin 32 and an inner skin 34. Inner skin 34 comprises a mouth rim element 36 and is configured and dimensioned so as to fit within the outer skin 32 with the mouth rim element 36 in 30 contact with the mouth rim engagement portion 38 of the outer skin 32. The mouth rim element 36 is adapted to be joined to the mouth rim engagement element 38 by welding, use of an adhesive or other fixing means.

Figure 8:
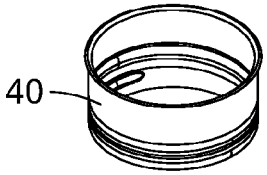
FIG. 8 shows a first view of the outer cap skin of the drinking vessel of FIG. 1.
Figure 9:
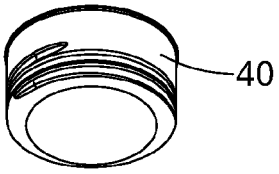
FIG. 9 shows a second view of the outer cap skin of the drinking vessel of FIG. 1.
Figure 10:
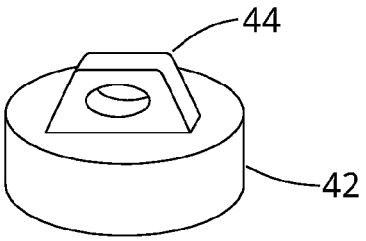
FIG. 10 shows a view of the inner cap element of the drinking vessel of FIG. 1.

With reference to FIGS. 8, 9 and 10, the bottle cap 8 is comprised of an outer cap element 40 and an inner cap element 42. The inner cap element 42 is dimensioned and configured to fit within the volume defined by the outer cap skin 40. In the illustrated embodiment the inner cap element 42 is fixed into the outer cap skin 40 by way of an adhesive. In other embodiments, not shown, the outer cap skin 40 and 5 the inner cap element 42 are both so configured that the inner cap element 42 is retained in the outer cap skin 40 by friction or a mechanical interference.

The bottle cap 8 has a handle 44 that is integral with the inner cap element 42. The handle 44 may be used to rotate the bottle cap 8. Rotation of the bottle cap 8 does 10 not cause the inner cap element 42 to wholly or partially come out of the volume defined by the outer cap skin 40 because the inner cap element 42 is either permanently or reversibly fixed in outer cap skin 40. The handle 44 of the inner cap element 42 includes an aperture 46 which allows a hook, loop or other fixing means to be engaged with the bottle cap 8. That fixing means may also be attached to the bottle 4 so as to avoid loss of the cap 8, or may be used to attach the bottle to some external object, for example a rucksack or belt so that the drinking vessel is not lost.

With reference to FIG. 2, the cup 6 comprises a cup base 46 which is circular, a side wall 48, and a recess wall 50. The recess wall 50, together with the cup base 46, defines a storage recess. The storage recess has a storage recess mouth 52 which is defined by recess wall free edge 53 and faces directly away from the bottle cap 4.

Figure 11:
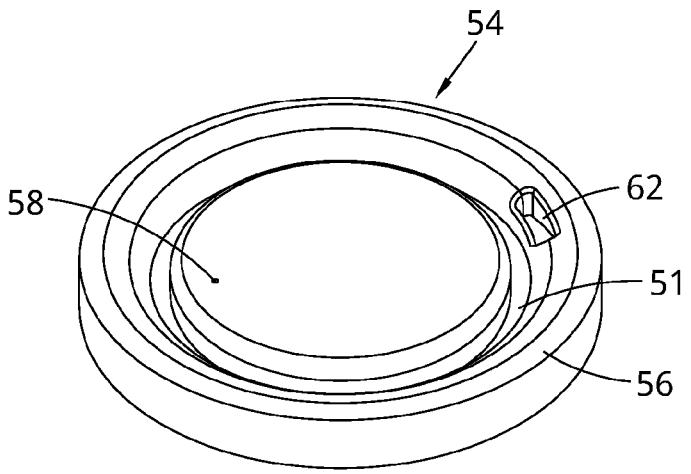
FIG. 11 shows a perspective view of a first embodiment of the cup lid of the drinking vessel of FIG. 1.
Figure 12:
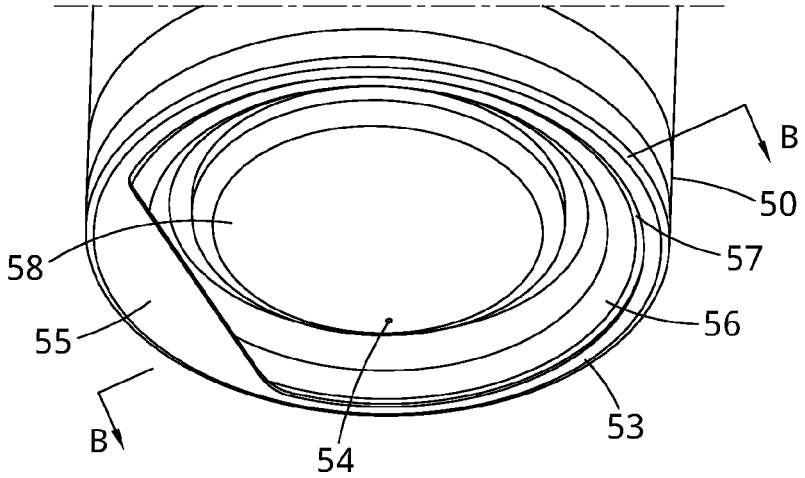
FIG. 12 shows a perspective view of the cup lid FIG. 11 in the storage recess.
Figure 13:
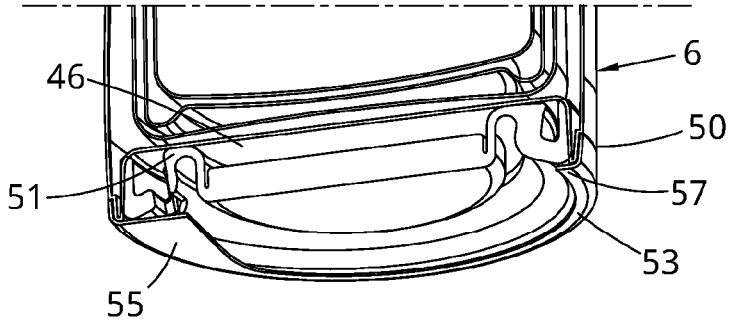
FIG. 13 shows a cross section of the cup lid of FIG. 11 in the storage recess along the section BB.
Figure 14:
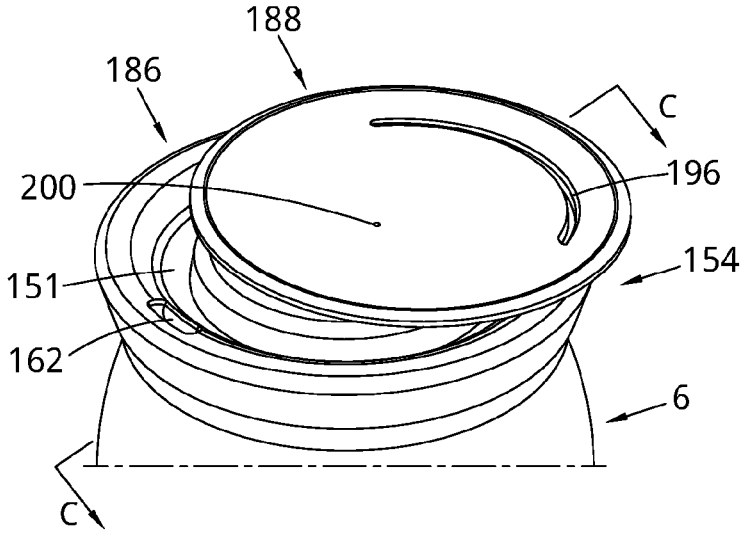
FIG. 14 shows a perspective view of a second embodiment of a cup lid according to an embodiment of the present invention engaged with the cup mouth.

With reference to FIGS. 11, 12 and 13, the bottle 2 of the illustrated embodiment of the present invention further comprises a cup lid 54. The cup lid 54 is comprised of a lid band 56, a lid plate 58 and a deformation zone 51 radially inside the lid band 56. The lid band 56, deformation zone 51, and lid plate 58 are formed from an elastomeric material, for example a silicone rubber, and are integral with each other.

The cup lid 54 includes a first drinking aperture 62 and a vent aperture (not shown).

The lid 54 is dimensioned so that it can reversibly be located within the storage recess defined by the recess walls 50 and the cup base 46. The free edge 53 of the recess walls 50 includes a retaining plate 55 and a retaining ridge 57. The retaining plate has the form of a circular segment which partially closes the mouth of the storage recess. The retaining ridge 57 extends around the portion of the free edge 53 not engaged with the retaining plate 55 and again partially closes the mouth of the retaining plate. The dimensions of the lid and the storage recess are such that when the lid 54 is pushed into the storage recess the lid band 56 and deformation zone 51 are elastically deformed/compressed so that the lid can pass through the aperture defined by the retaining plate 55 and retaining ridge 57. Once within the storage recess some of the elastic deformation may be reversed and the still deformed lid band pushes against the inside face of the recess wall 50. The push against the inside face of the recess wall 50, the retaining plate 55 and the retaining ridge 57 serve to retain the cup lid in the storage recess. A user can deform the lid band 56 and deformation zone 51 to remove the cup lid 54 from the storage recess. The dimensions of the retaining plate 55 are such that the aperture 62 and immediately surrounding lid band 56, that is the portion of the lid band that a user is likely to contact with their lips when drinking out of the aperture 62, of the cup may be fully covered by the retaining plate when the cup lid is in the storage recess. This is desirable for hygiene reasons.

The dimensions of the mouth of the cup 6 and the dimensions and configuration of the lid band 56 are such that the lid band 56 may sealingly and reversibly grip the portion 68 of the cup and close the mouth of the cup.

Figure 15:
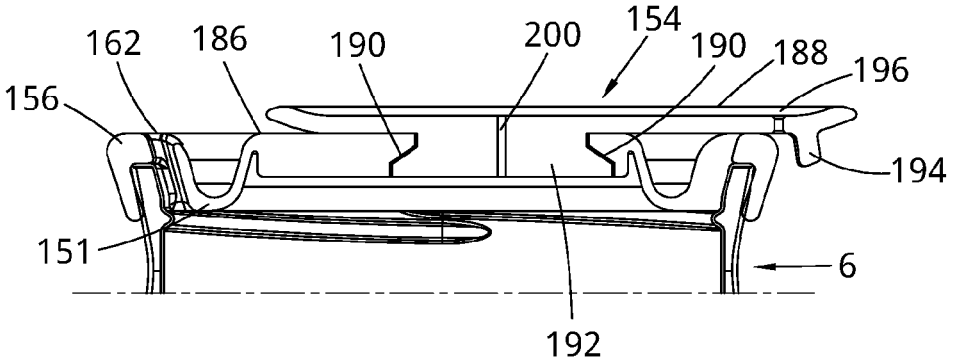
FIG. 15 shows a cross section of the cup lid of FIG. 14 along the section CC.
Figure 16:
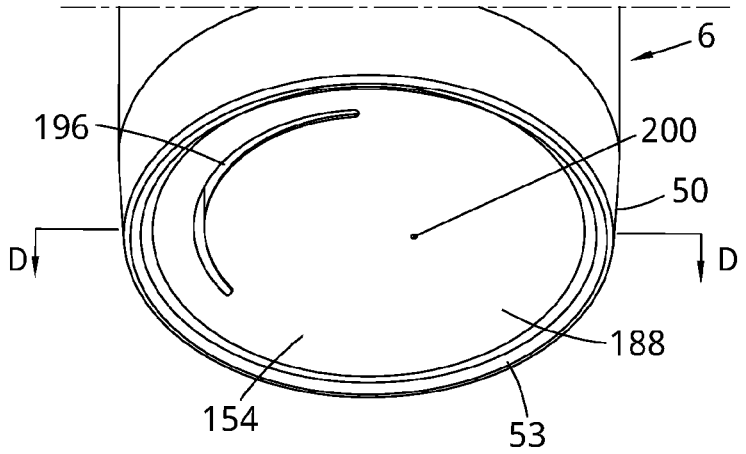
FIG. 16 shows a perspective view of the cup lid FIG. 14 in the storage recess.

With reference to FIGS. 14, 15, 16 and 17, an alternative embodiment of a cup lid 154 is shown. The cup lid 154 is comprised of a first lid element 186 and a second lid element 188. The first lid element 186 includes an aperture 162 through which a user may drink, a lid rim 156, and a deformation zone 151. The first lid element also includes a circular aperture defined by an edge 190 which is configured to receive a hinge pin 192 which is part of the second lid element 188. The aperture is circular in the plane of the upper (as seen in FIG. 15) face of the first lid element 186.

The second lid element 188 includes the hinge pin 192, an aperture closure element 194, a breather hole 200, and an arcuate slit 196. The hinge pin 192 is configured to be in sliding engagement with the edge 190 of the first lid element 186 and be able to rotate within the aperture defined by the edge 190 about the hinge pins longitudinal axis. The aperture closure element 194 is located between the arcuate slit 196 and the radially outer edge of the second lid element 188 and approximately midway along the arcuate slit 196.

The first and second lid elements 186, 188 are both formed from a food grade silicon rubber and are elastically deformable.

Figure 17:
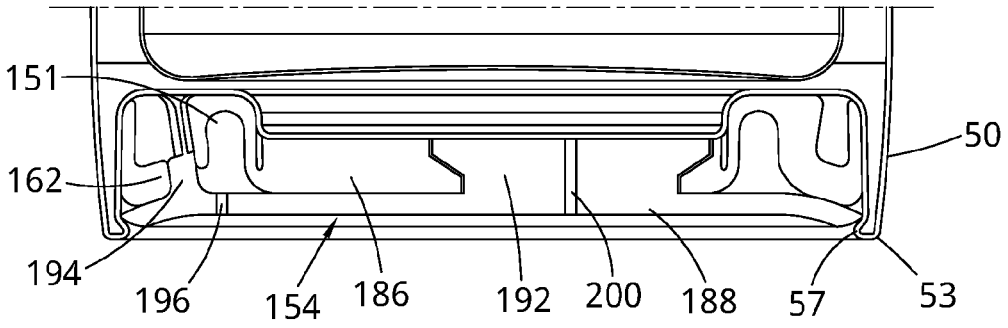
FIG. 17 shows a cross section of the cup lid of FIG. 16 in the storage recess along the section DD.

Rotation of the hinge pin 192 about its longitudinal axis may move the second lid element from an open position as shown in FIG. 15 to a closed position shown in FIG. 17.

In the open position the aperture 162 is open and a user may drink through the aperture 162.

In the closed position the aperture closure element 194 is in the aperture 162 and prevents the flow of liquid through aperture 162.

Movement of the second lid element 188 from the open position to the closed position causes the closure element 194 to interfere with a portion of the lid rim 156. To overcome that interference the arcuate slit 196 allows the portion of the second lid element 188 to flex away from the lid rim 156 until the aperture closure element 194 enters the aperture 162 at which time the flexed portion of the second lid element returns to its original non-flexed position.

The lid 154 fits into the storage recess in the same fashion as the lid 54 shown in FIGS. 11 to 13. In this instance, however, there is no retaining plate and the retaining ridge 57 extends the full way around the mouth of the storage recess. The lid 154 fits onto the cup in the same fashion as the lid 54.

The bottle 4 is comprised of a lower region 70 which extends from adjacent to the bottle base 20 to a first intermediary position 74. The outside face of the outer skin 12 substantially forms the whole of the lower region 70. Spaced from the first intermediate position 74 is a second intermediate position 76 and the upper region of the bottle extends from the second intermediate position 76 to a second position 78. The bottle 4 tapers from the second position 78 toward the mouth of the bottle.

Between the first and second intermediate positions 74, 76 the bottle wall is a single 30 skin to form a waist 80 which has a smaller cross section than either the lower region of the bottle 70 at the first intermediate position 74 or the upper region of the bottle 72 at the second intermediate position 76. That waist has located within it a seal ring 82 which is held in positon by elastic deformation of the seal ring and the ends of the 17 lower region 70 and upper region 72. The seal ring 82 is configured so that the engagement portion 68 of the cup 6 overlies and compresses the seal ring 82 when the cup 6 is pushed into a position where it overlies the whole of the lower region 70 and engages with the seal ring 82. The seal ring 82 is preferably of an elastomeric material such as silicone and thermally insulates the waste 80 portion of the bottle 4.

The space 30 between the inner skin and outer skins of the bottle 4 is, in the illustrated embodiment, filled with air. Air is a good insulator and as such the bottle 4 is insulated and can keep hot beverages hot or cold beverages cold. The lower portion 70 of the bottle is further thermally insulated by the cup 6 which, again, has 10 air located between the cup outer skin 32 and cup inner skin 34.

In the illustrated embodiment of the present invention there is a small space between the inside face of the inner skin 34 of the cup 6 and the outside face of the outer skin 12 of the bottle 4. In other, non-illustrated, embodiments the dimensions of 15 the cup and the bottle are such that the inner face of the cup 6 is in sliding contact with the outer face of the lower region 70 of the bottle 4.

In use, a beverage, for example hot coffee, is stored within the volume 84 defined by the inner face of the inner skin 10 of the bottle 4 until a user wishes to drink that 20 beverage. The cup 6 is located so that it is overlying the lower region 70 of the bottle 4 and retained in that position. When a user wants to drink some or all of the beverage, the user takes the cup 6 off the base of the bottle 4 and takes the cup lid 54 out of the storage recess at the base of the cup. The bottle cap 8 is removed and the beverage poured in to the cup 6. The cup lid 54 is placed into the mouth of 25 the cup 6. The cup 6 now acts as an insulated travel mug and allows the user to sip the beverage through the drinking aperture 62 of the cup lid 54. When the user has finished drinking their beverage the cup lid 54 is placed back into the storage recess and the cup 6 back into position on the bottle 4.

The drinking vessel 2 of the illustrated embodiment is, unless indicated otherwise, formed from elements made from stainless steel. This has the benefit of producing a robust drinking vessel which, without surface treatment, is resistant to reaction with 18 the beverage.

Statements of Invention

1. A drinking vessel comprising a bottle, a bottle cap and a cup in which the bottle is comprised of a bottle base, a bottle mouth and one or more bottle side walls, an edge of the or each bottle wall is joined to the bottle base, the or each bottle wall extend between the bottle base and the bottle mouth, the or each edge of the bottle wall remote from the bottle base defines the bottle mouth, and the or each bottle wall has an inner face, which defines the volume within the bottle in which a beverage may be held, and an outer face, the bottle cap is configured to reversibly close the bottle mouth, the cup is comprised of a cup base, a cup mouth and one or more cup walls, the or each cup wall are joined to the cup base, the or each cup wall extend between the cup base and the cup mouth, an edge of the or each cup wall remote from the cup base defines or is adjacent to the cup mouth, and the or each cup wall has an inner face which defines the volume within the cup in which a beverage may be stored, and an outer face, characterised in that the bottle comprises a lower portion and an upper portion in which the lower portion extends from the bottle base to a first intermediate position between the bottle base and the bottle mouth, the upper portion extends from a second intermediate position to a second position where the second intermediate position is between the first intermediate position and the second position, and the second position is between the second intermediate position and the bottle mouth, the cup is configured and dimensioned so that it can reversibly overlie the bottle base and at least a portion of the outer face of the lower portion of the bottle with 25 the inner face of the or each cup wall in contact with or close proximity to the outer face of the lower portion of the bottle, and the outer face of the or each cup wall adjacent to or at the cup mouth is of substantially the same dimensions as the dimensions of the outer face of the upper portion of the bottle at or adjacent to the second intermediate position.

2 A drinking vessel according to statement 1 in which at least a substantial portion of the lower portion of the bottle side wall or walls has wall thickness of up to a first wall thickness, at least a substantial portion of the upper portion of the bottle side wall or walls has a thickness of at least a second wall thickness, and the second wall thickness is greater than or equal to the first wall thickness.

3 A drinking vessel according to statement 2 in which at least a substantial portion of the upper portion of the bottle side wall or walls is constructed to thermally insulate 5 the content of the volume defined by the inner face of the bottle wall or walls from the outside of the bottle.

4 A drinking vessel according to statement 2 or 3 in which at least a substantial portion of the upper portion of the bottle side wall or walls is constructed from an inner bottle skin and an outer bottle skin, the inner and outer bottle skins are spaced from each other, and the space between the inner and outer bottle skins is filled with at least one of a gas substantially at atmospheric pressure, a gas below atmospheric pressure, a solid insulating material, or a liquid insulating material.

5 A drinking vessel according to any of statements 2 to 4 in which at least a substantial portion of the lower portion of the bottle side wall or walls is constructed from an inner bottle skin and an outer bottle skin, in which the inner and outer bottle skins are in contact with each other.

6 A drinking vessel according to any of statements 2 to 4 in which at least a substantial portion of the lower portion of the bottle side wall or walls is constructed from an inner bottle skin and an outer bottle skin, in which the inner and outer bottle skins are spaced from each other, and the space between the inner and outer bottle skins is filled with at least one of a gas substantially at atmospheric pressure, a gas below atmospheric pressure, a solid insulating material, or a liquid insulating material.

7 A drinking vessel according to any of statements 1 to 6 in which the first and second intermediate positions are substantially coincident with each other.

8 A drinking vessel according to statement 7 in which there is a step change in thickness of the bottle side wall at the first/second intermediate position.

9 A drinking vessel according to statements 7 or 8 in which the drinking vessel further comprises a seal ring, and the seal ring overlies the outer face of a portion of the lower portion of the bottle side wall or walls.

10 A drinking vessel according to any of statements 1 to 6 in which the first and second intermediate positions are spaced from each other, and the portion of the bottle wall or walls between the first and second intermediate positions has outer dimensions smaller than both the lower portion at or adjacent to the first intermediate position and the upper portion at or adjacent to the second intermediate position.

11 A drinking vessel according to statement 10 in which the drinking vessel further comprises a seal ring, and the seal ring overlies the portion of the bottle wall or walls between the first and second intermediate positions.

12 A drinking vessel according to statement 9 or 11 in which the seal ring is an elastomeric material.

13 A drinking vessel according to statement 12 in which the seal ring is a silicone material.

14 A drinking vessel according to any of statements 9, or 11 to 13 in which the seal ring and cup are dimensioned and configured so that the cup mouth can be reversibly pushed into a position in which a portion of the inner face of the cup at least partially overlies and compresses the seal ring.

15 A drinking vessel according to any of statements 1 to 14 in which at least a portion of the cup side wall or walls is constructed from an inner cup skin and an outer cup skin spaced from each other, and the space between the inner and outer cup skins is filled with at least one of a gas substantially at atmospheric pressure, a gas below 30 atmospheric pressure, a solid insulating material, or a liquid insulating material.

16 A drinking vessel according to any of statements 1 to 15 in which the cup further comprises a storage recess and a cup lid, characterised in that the cup lid is configured to reversibly engage with the cup mouth and or cup wall or walls adjacent the cup mouth, and the storage recess is configured to reversibly retain the cup lid within the storage recess.

17 A drinking vessel according to statement 16 in which a portion of the cup lid which engages with the cup mouth and or cup wall or walls adjacent the cup mouth and or with the storage recess is elastically deformable.

18 A drinking vessel according to any of statements 1 to 17 which further comprises an upstanding portion extending from the centre of the cup lid away from the volume defined by the cup when the cup lid is closing the mouth of the cup, the outer face of that upstanding portion comprises one or more screw threads, the storage recess further comprises a bore, and the bore comprises one or more matching screw threads on the inside face of the bore.

19 A drinking vessel according to any of statements 1 to 17 in which the cup lid further comprises a bore extending into the cup lid toward the volume defined by the cup when the cup lid is closing the mouth of the cup, the inside face of the bore comprises one or more screw threads, the storage recess further comprises an upstanding portion extending from the cup base with one or more matching screw threads on the outer face of that upstanding portion.

20 A drinking vessel according to any of statements 16 to 19 in which storage recess is defined by the cup base and one or more storage recess side walls, and the one or more storage recess side walls extend in a direction away from the cup mouth.

21 A drinking vessel according to any of statements 16 to 20 in which the cup lid defines one or more apertures through the lid.

22 A drinking vessel according to statements 21 in which the cup lid is configured to 30 allow one or more of the apertures to be reversible closed.

23 A drinking vessel according to any of statements 1 to 22 in which the bottle cap is comprised of an outer cap skin and an inner cap element, the outer cap skin is configured and dimensioned to reversibly engage with the bottle mouth or the bottle wall or walls adjacent the bottle mouth, and the inner cap element is configured to engage with the outer cap skin.

24 A drinking vessel according to statements 23 in which the engagement between the outer cap skin and the bottle wall or walls adjacent the bottle mouth is via a right hand thread, and the engagement between the outer cap skin and the inner cap element is via a left hand thread.

The invention claimed is:

1. A drinking vessel comprising a bottle, a cup, and a cup lid, wherein:

the bottle comprises a bottle base, a bottle mouth, and a bottle wall extending between the bottle base and the bottle mouth, the cup comprises a cup base, a cup mouth, and a cup wall, wherein a first face of the cup base and an inner face of the cup wall define a cup volume, the cup volume is suitable for holding a potable beverage, and the inner face of the cup wall extends from the cup base to a free edge of the cup wall which defines the cup mouth, the cup lid is configured to reversibly engage with one or both of the free edge of the cup wall and the portion of the cup wall adjacent the free edge, and the cup lid is configured to close the cup mouth, the cup base and cup wall are configured in such a manner that the bottle base and at least a portion of bottle wall fit into the cup volume with the inner face of the cup wall in close proximity to the portion of a bottle wall, the cup further comprises a lid storage recess that is defined by a second face of the cup base and an inner face of a recess wall, wherein the second face of the cup base faces away from the cup volume, the inner face of the recess wall extends from the second face of the cup base away from the cup volume to a recess wall free edge, and the recess wall free edge defines a recess mouth, the cup lid comprises a cup wall engaging means, and drinking aperture, the cup lid and lid storage recess are configured in such a manner that the cup lid reversibly engages with the cup lid storage recess so that the cup lid is reversibly retained in the lid storage recess, and the cup further comprises a base cap, and the base cap is configured to reversibly close the mouth of the lid storage recess.

2. A drinking vessel according to claim 1 in which the cup lid is at least partially elastically deformable, and insertion and removal of the cup lid into and/or out of the lid storage recess requires elastic deformation of the at least part of the cup lid.

3. A drinking vessel according to claim 1 in which the cup lid is wholly elastically deformable.

4. A drinking vessel according to claim 1 in which the cup wall engaging means of the cup lid is elastically deformable, and insertion and removal of the cup lid into and/or out of the lid storage recess requires the elastic deformation of the cup wall engaging means.

5. A drinking vessel according to claim 1 in which the cup lid further comprises a deformation zone, the cup wall engaging means of the cup lid extends around the outside perimeter of the cup lid, the deformation zone is approximately parallel to the cup wall engaging means, and insertion and removal of the cup lid into and/or out of the lid storage recess requires elastic deformation of the deformation zone.

6. A drinking vessel according to claim 1 wherein:

the cup lid further comprises a first lid element and a second lid element, wherein the first lid element comprises the cup wall engaging means, the drinking aperture, and a rotating joint element, the second lid element comprises a drinking aperture closure element and a rotating joint element, the rotating joint elements of the first and second lid elements combine to form a 360° hinge between the first and second lid elements, and rotation of the second lid element relative to the first lid element may move the second lid element between (i) a closed position where the drinking aperture closure element may close the drinking aperture and (ii) an open position where the drinking aperture closure element may not close the drinking aperture.

7. A drinking vessel according to claim 6 in which at least a portion of the second lid element is elastically deformable and deformation of the second lid element when it is in the closed position allows the drinking aperture closure element to close the drinking aperture.

8. A drinking vessel according to claim 6 in which the cup mouth is substantially planar, and the axis about which the second lid element rotates relative to the first lid element is within about 10 degrees of perpendicular to the plane of the cup mouth when the cup wall engaging means of the cup lid is engaged with the cup wall.

9. A drinking vessel according to claim 1 in which the base cap is engaged with the recess wall via an engagement means.

10. A drinking vessel according to claim 9 in which the engagement means is a screw thread.

11. A drinking vessel comprising a bottle, a cup, and a cup lid, wherein:

the bottle comprises a bottle base, a bottle mouth, and a bottle wall extending between the bottle base and the bottle mouth, the cup comprises a cup base, a cup mouth, and a cup wall, wherein a first face of the cup base and an inner face of the cup wall define a cup volume, the cup volume is suitable for holding a potable beverage, and the inner face of the cup wall extends from the cup base to a free edge of the cup wall which defines the cup mouth, the cup lid is configured to reversibly engage with one or both of the free edge of the cup wall and the portion of the cup wall adjacent the free edge, and the cup lid is configured to close the cup mouth, the cup base and cup wall are configured in such a manner that the bottle base and at least a portion of bottle wall fit into the cup volume with the inner face of the cup wall in close proximity to the portion of a bottle wall, the cup further comprises a lid storage recess that is defined by a second face of the cup base and an inner face of a recess wall, wherein the second face of the cup base faces away from the cup volume, the inner face of the recess wall extends from the second face of the cup base away from the cup volume to a recess wall free edge, and the recess wall free edge defines a recess mouth, the cup lid comprises a cup wall engaging means, and drinking aperture, and the cup lid and lid storage recess are configured in such a manner that the cup lid reversibly engages with the cup lid storage recess so that the cup lid is reversibly retained in the lid storage recess, the recess wall comprises at least one retaining projection, each retaining projection extends from the free edge of the recess wall or from a portion of the inner face of the recess wall, and each retaining projection extends over a part of the recess mouth or into the lid storage recess, at least one retaining projection is a retaining plate, the free edge of the recess wall defines a substantially circular recess mouth, and the retaining plate is substantially a circular segment.

12. A drinking vessel according to claim 11 in which at least one retaining projection is a ridge, and in which the ridge extends in a longitudinal direction that is substantially parallel to the free edge of the recess wall.

13. A drinking vessel according to claim 12 in which the ridge extends the whole length or substantially the whole length of the free edge of the recess wall.

14. A drinking vessel according to claim 11 in which the cup lid is at least partially elastically deformable, and insertion and removal of the cup lid into and/or out of the lid storage recess requires elastic deformation of the at least part of the cup lid.

15. A drinking vessel according to claim 11 in which the cup lid is wholly elastically deformable.

16. A drinking vessel according to claim 11 in which the cup wall engaging means of the cup lid is elastically deformable, and insertion and removal of the cup lid into and/or out of the lid storage recess requires the elastic deformation of the cup wall engaging means.

17. A drinking vessel according to claim 11 in which the cup lid further comprises a deformation zone, the cup wall engaging means of the cup lid extends around the outside perimeter of the cup lid, the deformation zone is approximately parallel to the cup wall engaging means, and insertion and removal of the cup lid into and/or out of the lid storage recess requires elastic deformation of the deformation zone.

18. A drinking vessel according to claim 11 wherein:

the cup lid further comprises a first lid element and a second lid element, wherein the first lid element comprises the cup wall engaging means, the drinking aperture, and a rotating joint element, the second lid element comprises a drinking aperture closure element and a rotating joint element, the rotating joint elements of the first and second lid elements combine to form a 360° hinge between the first and second lid elements, and rotation of the second lid element relative to the first lid element may move the second lid element between (i) a closed position where the drinking aperture closure element may close the drinking aperture and (ii) an open position where the drinking aperture closure element may not close the drinking aperture.

19. A drinking vessel according to claim 18 in which at least a portion of the second lid element is elastically deformable and deformation of the second lid element when it is in the closed position allows the drinking aperture closure element to close the drinking aperture.

20. A drinking vessel according to claim 18 in which the cup mouth is substantially planar, and the axis about which the second lid element rotates relative to the first lid element is within about 10 degrees of perpendicular to the plane of the cup mouth when the cup wall engaging means of the cup lid is engaged with the cup wall.

* * * * *